US006416592B2

(12) United States Patent
Kondo et al.

(10) Patent No.: US 6,416,592 B2
(45) Date of Patent: Jul. 9, 2002

(54) ELECTROMAGNETIC STEEL SHEET HAVING EXCELLENT MAGNETIC PROPERTIES AND PRODUCTION METHOD THEREOF

(75) Inventors: Osamu Kondo; Akihiro Matsuzaki; Shigeaki Takajo, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/779,041

(22) Filed: Feb. 8, 2001

Related U.S. Application Data

(62) Division of application No. 09/134,305, filed on Aug. 14, 1998, now Pat. No. 6,248,185.

(30) Foreign Application Priority Data

Aug. 15, 1997 (JP) ..... 9-220394
Sep. 9, 1997 (JP) ..... 9-244216
Dec. 4, 1997 (JP) ..... 9-334137

(51) Int. Cl.[7] ..... H01F 1/14
(52) U.S. Cl. ..... 148/120; 148/111
(58) Field of Search ..... 148/111, 120

(56) References Cited

U.S. PATENT DOCUMENTS

| | | | | |
|---|---|---|---|---|
| 3,881,967 A | | 5/1975 | Cochardt et al. | |
| 3,892,605 A | | 7/1975 | Thornburg | |
| 4,416,707 A | | 11/1983 | Foster et al. | |
| 4,473,416 A | * | 9/1984 | Kawamo et al. | 148/111 |
| 4,502,982 A | | 3/1985 | Horie et al. | |
| 5,190,722 A | | 3/1993 | Saito et al. | |
| 5,545,263 A | * | 8/1996 | Yoshitomi et al. | 148/111 |

FOREIGN PATENT DOCUMENTS

| | | | |
|---|---|---|---|
| EP | 0 551 141 A1 | | 7/1993 |
| EP | 0 743 370 A2 | | 11/1996 |
| JP | 63-026338 | | 2/1988 |
| JP | 1-108345 | * | 4/1989 |
| JP | 2-274844 | * | 11/1990 |
| JP | 4-218647 | * | 8/1992 |
| JP | 4-346621 | * | 12/1992 |
| JP | 5-271774 | * | 10/1993 |
| JP | 7-23509 | * | 3/1995 |
| JP | 7-26154 | * | 3/1995 |
| JP | 8-199242 | * | 8/1996 |
| JP | 9-41101 | * | 2/1997 |
| JP | 2708682 | * | 10/1997 |

OTHER PUBLICATIONS

"Growth of (110)[001]–Oriented Grains in High–Purity Silicon Iron–A Unique Form of Secondary Recrystallization" by J. L. Walker and C. G. Dunn, Transactions of the Metallurgical Society of AIME, vol. 218, Dec. 1960, pp. 1033–1038.*

* cited by examiner

*Primary Examiner*—John Sheehan
(74) *Attorney, Agent, or Firm*—Schnader Harrison Segal & Lewis LLP

(57) ABSTRACT

Electromagnetic steel sheet having excellent magnetic properties and a texture gratly integrated in the {100}<001> orientation, and an uncomplicated and low cost production method; with about a 15 $\mu\Omega$·cm or more specific resistivity, about a 2.0 or more {100}<001> integration degree/{111}<uvw> integration degree and about a 10 $\mu$m to 500 $\mu$m grain diameter; when about 0.1 to 3.5% by weight of Si is present, the {100}<001> integration degree is about 10 or more; when about 0.2 to 1.2% by weight of P is present, the{100}<001> integration degree is about 3 or more; by applying a large reduction ratio to a steel slab in the vicinity of the final stage of hot rolling, with the hot rolling finishing temperature controlled at about 750 to 1150° C., hot rolled steel having a texture highly integrated in the {100}<001> orientation is economically produced.

9 Claims, 1 Drawing Sheet

FIGURE
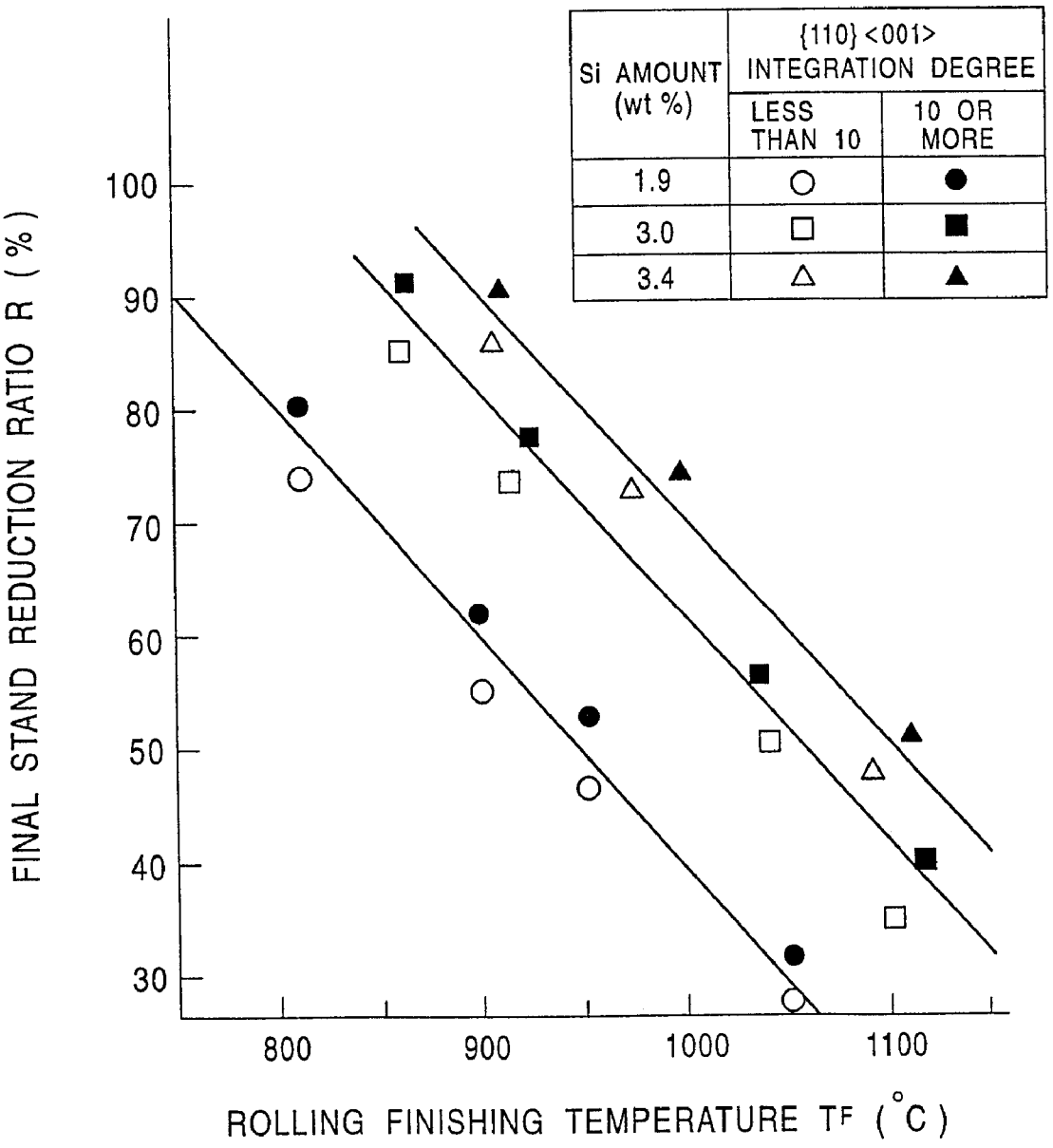

ELECTROMAGNETIC STEEL SHEET HAVING EXCELLENT MAGNETIC PROPERTIES AND PRODUCTION METHOD THEREOF

This application is a divisional of application Ser. No. 09/134,305, filed Aug. 14, 1998, now U.S. Pat. No. 6,248,185 incorporated herein by reference.

BACKGROUND OF THE INVENTION

1. Field of the Invention

The present invention relates to an electromagnetic steel sheet having excellent magnetic properties, preferably to an electromagnetic steel sheet for application as a magnetic core, and a production method thereof.

2. Description of the Related Art

It is preferable that an electromagnetic steel sheet (silicon steel sheet) has a texture such that the electromagnetic properties in the magnetization direction in use can be excellent. A preferable texture varies depending upon the application. However, for an EI core, which has the magnetization directions orthogonal to each other, a so-called cubic texture with a {100} rolled face orientation and a <100> rolling orientation (RD) is most preferable.

In order to obtain such a texture, various methods have been advocated so far.

Examples thereof include a melt quenching method disclosed in the official gazette of Japanese Unexamined Patent Publication No. 5-306438, a cross rolling method disclosed in the official gazette of Japanese Unexamined Patent Publication No. 5-271774, a tertiary recrystallization method disclosed in "Growth of (110)[001]-Oriented Grains in High-Purity Silicon Iron-A Unique Form of Secondary" (TRANSACTIONS OF THE METALLURGICAL SOCIETY OF AIME, VOL 218, 1960 P. 1033–1038), and a columnar crystal growth method disclosed in the official gazette of Japanese Unexamined Patent Publication No. 62-262997.

However, since all of the above-mentioned methods excluding the melt quenching method depend on cold rolling and annealing, a complicated process is required as disclosed in the official gazette of Japanese Unexamined Patent Publication No. 4-346621. Further, the melt quenching method requires a special cooling roller. Therefore, in either of the methods, high production costs have been problematic.

On the other hand, a grain oriented silicon steel sheet is known as an expensive electromagnetic steel sheet. The grain oriented silicon steel sheet has a texture having a so-called Goss orientation, {110}<001> orientation in the vicinity of the surface layer of the hot rolled steel sheet in a small amount so that secondary recrystallization can be conducted, utilizing the Goss orientation grains. The magnetic properties thus obtained are superior in the rolling direction (RD), but inferior in the transverse direction (TD).

It has been a common view that Si is superior to other alloy elements from the comprehensive aspect although some elements are superior to Si in one of the characteristics including magnetic and mechanical properties, in particular, processability and alloy cost. However, the present inventors elaborately studied the application of the alloy elements other than Si into an electromagnetic steel sheet and discovered that an electromagnetic steel sheet with an Fe—P composition can obtain properties superior to those of a silicon steel sheet as disclosed in of Japanese Unexamined Patent Publication No. 9-41101.

SUMMARY OF THE INVENTION

An object of the present invention is to provide an electromagnetic steel sheet having a texture that is highly integrated in the {100}<001> orientation, at a low cost, all without the need of a complicated process.

A further object is to create a method of making such an electromagnetic steel sheet.

We have discovered that the texture of steel having a specific resistivity of about 15 $\mu\Omega\cdot$cm or more can be improved by applying sufficient strain at a high temperature, and by large reduction in hot finish rolling, step compared with the conditions adopted in the conventional process. The steel sheet of this invention is extremely effective for the targeted objective.

Preferred configurations of the present invention include the following embodiments:

1. An electromagnetic steel sheet having excellent magnetic properties, with about a 15 $\mu\Omega\cdot$cm or more specific resistivity, about a 2.0 {100}<001> integration degree/{as a ratio to the 111}<uvw> integration degree, and has about a 10 $\mu$m to 500 $\mu$m grain size.

2. The electromagnetic steel sheet described in paragraph 1, wherein the steel sheet composition contains about 0.1 to 3.5% by weight of Si and the {100}<001> integration degree is about 10 or more.

3. The electromagnetic steel sheet described in paragraph 1, wherein the steel sheet composition contains about 0.2 to 1.2% by weight of P, and wherein the {100}<001> integration degree is about 3 or more.

4. A production method of the electromagnetic steel sheet described in paragraph 1, wherein a large reduction ratio is applied to a steel slab in the vicinity of the final stage of a hot rolling process, with the components adjusted such that the specific resistivity of the product is about 15 $\mu\Omega\cdot$cm or more and the hot rolling finishing temperature is about 750 to 1150° C.

5. A large strain, as described in paragraph 4, can inlude specifically a rolling operation in the hot rolling final pass, with about a 30% or more reduction ratio. In addition, the operation can include conducting finish rolling in the hot rolling process with 1 pass. Or the large strain described in paragraph 4 can include an operation with about a 50% or more hot rolling final 3 passes accumulated reduction ratio and about a 10% or more final pass reduction ratio.

6. A steel slab with the components adjusted such that the specific resistivity of the product can be about 15 $\mu\Omega\cdot$cm or more made according to the method described in paragraph 4, the steel slab containing about 0.1 to 3.5% by weight of Si, or about 0.2 to 1.2% by weight of P.

7. The production method of an electromagnetic steel sheet described in paragraph 4, wherein the slab is made from a component having a ferrite-austenite transformation at about 750 to 1150° C. and wherein and the hot rolling finishing temperature is $Ar_1$-100 to $Ar_1$+50° C.

8. The production method of an electromagnetic steel sheet described in paragraph 4, wherein the slab is made from a component to have a ferrite single phase at about 750 to 1150° C. and the hot rolling finishing temperature is higher than or equal to 1010+100×[Si]−5×reduction ratio of the final hot rolling pass (%).

In general, a steel slab (about 10 to 500 mm thickness) reheated to about 900 to 1450° C. is processed into a hot rolled steel sheet having about a 0.8 to 4.0 mm thickness by hot rolling. Usually the slab is processed to the form of a sheet bar having about a 15 to 50 mm intermediate thickness before converting the bar to the state of the hot rolled steel sheet. The hot rolling operation from the slab to the sheet bar denotes a rough rolling and the hot rolling operation from the sheet bar to the hot rolled steel sheet denotes a finish rolling. In some cases, a direct rolling operation without reheating the slab, or a finish rolling by directly casting the sheet bar can be conducted. The expression "vicinity of the final stage in a hot rolling process" according to the present invention refers to the stage from the final pass of the hot finish rolling to one or several passes before the final pass. Further, the expression "$Ar_1$ (° C.)" refers to the temperature achieving the ferrite single phase from the (ferrite+austenite) phase in the cooling of the steel.

According to the present invention, a steel sheet having a cubic texture, having excellent magnetic properties, can be provided by conducting hot finish rolling at a high temperature and providing large reduction, with the subsequent cold rolling process and the annealing process conducted in an ordinary manner without the need of a special condition. The resulting steel sheet can be produced at a cost that is drastically lower than conventional steel sheet.

BRIEF DESCRIPTION OF THE DRAWING

The FIGURE is a graph showing the influence of the reduction ratio (1 pass) R in the final stand, the rolling finishing temperature $T_F$ and the Si amount [Si] on the {100}<001> integration degree.

DETAILED DESCRIPTION OF THE INVENTION

Initially, the present invention will be explained with reference to an explanatory example.

A 50 kg steel ingot with a composition of 1.23% by weight of Si, 0.002% by weight of C, 0.003% by weight of O, 0.21% by weight of Mn and 0.23% by weight of Al, was melted in a small vacuum melting furnace, and a 5 mm thick sheet bar was obtained by hot rough rolling. In the slab composition, the specific resistivity was 28 $\mu\Omega$·cm, and the $Ar_1$ point was 960° C.

After being heated at 1150° C. for 25 minutes, the sheet bar was rolled by 700 mm diameter rolls at an 800 m/min peripheral speed, using an 80% reduction ratio and a 965° C. rolling finishing temperature, to obtain a hot rolled steel sheet having a thickness of 1.0 mm. The hot rolled steel sheet was subjected to heat treatment at 650° C. for 2 hours for the coil winding process, washed with acid, and subjected to cold rolling so as to obtain a cold rolled steel sheet having a thickness of 0.35 mm. Then, after degreasing the steel sheet, recrystallization annealing was applied at 850° C. for 20 seconds in a dry atmosphere containing 35% hydrogen and 65% nitrogen.

The degree of integration of the texture and the magnetic properties of the steel sheet were examined. The integration degree in a specific orientation represents the degree of frequency of the presence of crystal grains oriented in the orientation with respect to a texture having a completely random orientation distribution. It can be determined as follows. A sheet thickness part parallel to the sheet surface of a steel specimen was abraded so that the incomplete pole figure of (110), (200), and (211) with respect to the abraded surface was measured by the X-ray diffraction Schultz method. The resulting measurement data were converted to a three dimensional orientation distribution function using a series development method as disclosed in "Texture Analysis Materials Science" by H. J. Bunge.

Since the distribution function was standardized such that the existence frequency was 1 in any orientation when the distribution was completely random, in order to determine the integration degree in a specific orientation, the value of the distribution function in the direction was adopted. This value is a multiple of the integration degree with respect to a right random distribution.

The (110), (200) and (211) pole figures at each position of the steel sheet, equally divided into 10 sections in the sheet thickness direction from the surface thereof, were determined by the X-ray diffraction Schultz method. The three-dimensional distribution density was calculated for each of them, and the average value was obtained. As to the magnetic properties, a specimen having the longitudinal direction as the rolling direction (hereinafter referred to as the L direction) and a specimen having the longitudinal direction orthogonal to the rolling direction (hereinafter referred to as the C direction) were obtained so as to conduct the Epstein measurement.

As a result, the steel sheet had unprecedentedly excellent properties including a high {100}<001> integration degree of 18.7 and magnetic properties of 2.87 W/kg at $W_{15/50}$ and 1.842 T at $B_{50}$.

A steel sheet rolled at a 700° C. rolling temperature was examined similarly. The result shows that the {100}<001> integration degree declined.

That is, when the rolling finishing temperature was too low, since the texture in the {110}<001> orientation is formed by the deformation derived from the shearing strain so that the {100}<001> integration degree of the steel sheet produced after the subsequent processes declines and the magnetic flux density in the C direction is deteriorated, a steel sheet having a high {100}<001> integration degree could not be obtained.

Furthermore, even when the rolling finishing temperature was high, with a small reduction ratio, since a strain sufficient for the recrystallization of {100}<001> grains would not be applied, the {100}<001> integration degree of the steel sheet produced after subsequent processing declined and a steel sheet having a high {100}<001> integration degree could not be obtained.

An experimental result on a P steel, which is a basis for the present invention, will be explained.

A 50 kg steel ingot with a composition including 0.56% by weight of P, 0.003% by weight of C, 0.01% by weight of Si, 0.03% by weight of Mn and 0.05% by weight of Al, that is, a composition containing P and the remainder comprising Fe and incidental impurities, was melted in a small vacuum melting furnace. A 5 mm thick sheet bar was obtained from it by hot rough rolling. In the slab composition, the specific resistivity was 20 $\mu\Omega$·cm, and the $Ar_1$ point was 970° C.. After being heated at 1100° C. for 30 minutes, the steel sheet bar was rolled by a rolling apparatus having 700 mm diameter rolls with a 800 m/min peripheral speed, a 86% reduction ratio and a 950° C. rolling finishing temperature so as to obtain a hot rolled steel sheet having a 0.7 mm thickness.

After annealing the hot rolled steel sheet for 1 minute, the integration degree of the texture and the magnetic properties of the steel sheet were examined. As a result, the hot rolled steel sheet had unprecedented excellent properties including a high {100}<001> integration degree of 5.8 and a 1.816 T magnetic flux density at $B_{50}$ although a 6.2 W/kg iron loss at $W_{15/50}$ is just like a middle grade silicon steel sheet. A sheet thickness middle portion parallel to the sheet surface of a steel specimen was abraded so as to be measured by X-ray diffraction for calculating the three-dimensional orientation distribution function.

A steel sheet rolled with a 700° C. rolling temperature condition with the same composition was examined similarly and the result shows that the {100}<001> integration degree declined.

Furthermore, after cold rolling the hot rolled steel sheet obtained as mentioned above to a 0.5 mm thickness and annealing at 850° C. for 1 minute, the texture and the magnetic properties of the steel sheet were examined. As a result, when the hot rolling finishing temperature was 950° C., an {100}<001> integration degree of 5.5, which indicates that the integration degree at the hot rolled steel sheet stage was substantially maintained, a 4.6 W/kg iron loss at $W_{15/50}$, a 1.821 T magnetic flux density at $B_{50}$ were measured. An electromagnetic steel sheet having a magnetic flux density much higher than a conventional non-oriented electromagnetic steel sheet with the similar iron loss was obtained.

On the other hand, when the hot rolling finishing temperature was 700° C., the {100}<001> integration degree declined in the cold rolled steel sheet.

Furthermore, hot rolled steel sheets were prepared with the same kind of the steel as mentioned above with a 950° C. rolling finishing temperature so as to have a 1.25 mm sheet thickness. They were cold rolled with 30, 40, 60, 80, 90, 92% reduction ratios to have a 0.88, 0.75, 0.50, 0.25, 0.12, or 0.10 mm thickness, and annealed at 850° C. for 1 minute. The result of the examination on the texture and the magnetic properties thereof shows the {100}<001> integration degrees and the magnetic flux densities $B_{50}$ in the C direction as shown in Table 1.

TABLE 1

| Cold reduction ratio (%) | {100}<001> integration degree | {111}<uvw> integration degree | {100} <001> integration degree / {111} <uvw> integration degree | Magnetic flux density in C direction (T) |
|---|---|---|---|---|
| 30 | 4.2 | 1.98 | 2.12 | 1.83 |
| 40 | 7.3 | 1.68 | 4.53 | 1.86 |
| 60 | 12.0 | 1.30 | 9.23 | 1.88 |
| 80 | 10.9 | 1.86 | 5.86 | 1.87 |
| 90 | 8.5 | 4.00 | 2.13 | 1.86 |
| 92 | 5.8 | 4.53 | 1.28 | 1.83 |

With a 40 to 90% reduction ratio, the {100}<001> integration degree is further improved to be 7 or more compared with the hot rolled steel sheet and the magnetic flux density $B_{50}$ in the C direction was 1.86 T or more. That is, an electromagnetic steel sheet having a high magnetic flux density was obtained.

The present invention is based on the above-mentioned experimental facts where the composition ratio as well as the hot rolling condition are important.

That is, only when the temperature of a steel sheet at the time of finishing hot rolling is sufficiently high and the reduction ratio is sufficiently large, can a good texture be obtained.

By further applying cold rolling with an appropriate reduction ratio, the texture became reinforced. Although the reason thereof is not completely understood, it is believed that crystal grains with the right cubic orientation dominantly appear in the recrystallization at the rolling deformation under specific conditions of hot rolling.

As to the degree of integration improvement of the texture by cold rolling and annealing, this is surprising. Although in conventional knowledge the texture had been considered to be destroyed by a large amount of reduction, and to reduce the integration degree conversely, the actual integration degree was improved. This phenomenon is considered to relate to the special texture of the hot rolled steel sheet. However, a full explanation of the phenomenon has not so far been realized.

In order to examine the influence of the Si amount and the hot rolling condition in a ferrite single phase steel sheet, silicon steel slabs with a composition including 1.9%, 3.0%, and 3.4% by weight of Si were heated to 1250° C., and 1.4 to 10 mm thickness sheet bar was obtained by hot rough rolling. Finish rolling was applied in various conditions to have a 1.0 mm sheet thickness. The hot rolled steel sheets were applied with a heat treatment at 650° C. for 2 hours for the coil winding process, washed with acid, and subjected to cold rolling so as to obtain cold rolled steel sheets having a 0.35 mm thickness. Then, after degreasing each steel sheet, recrystallization annealing was applied at 850° C. for 20 seconds in a dry atmosphere containing 35% hydrogen and 65% nitrogen. The specific resistivities were 34, 49, and 53 $\mu\Omega\cdot$cm.

The average values of the three dimensional orientation distribution density in the sheet thickness direction of the steel sheet accordingly obtained calculated as mentioned above are shown in the Figure.

As shown in the Figure, in order to obtain a desired texture in a ferrite single phase steel sheet, it is important to satisfy a certain relational formula with respect to the final stand reduction ratio (1 pass) R, the rolling finishing temperature $T_F$, and the Si amount [Si]:

$$1150 \geqq T_F \geqq 1010+100\times[\mathrm{Si}]-5\times R.$$

Only when hot finish rolling is conducted in the condition satisfying the relational formula, can the targeted purpose be achieved.

In the present invention, the steel slab needs to have the composition ratio such that a specific resistivity of the product is higher than that of ordinary steel.

Specifically, a resistivity value of 15 $\mu\Omega\cdot$cm or more is required. With a lower value, the eddy current loss becomes large and, thus, the product cannot be used as an electromagnetic steel sheet. An example of the specific composition capable of providing such a specific resistivity will be described below.

Si has an effect to increase the specific resistivity and reduce the eddy current loss. With an Si amount less than about 0.1% by weight, the effect cannot be achieved sufficiently. On the other hand, with an Si amount exceeding about 3.5% by weight, the magnetic flux density drastically declines and the processability also deteriorates. Therefore, the range of the Si amount is defined to be about 0.1 to 3.5% by weight.

P has the effect to increase the specific resistivity and reduce the eddy current loss. That is, although the magnetic flux density is slightly lowered with a P increase, P is more advantageous than Si due to less decline in the magnetic flux density when P and Si are compared in the same specific resistivity level. With a P amount less than about 0.2% by weight, the above-mentioned effect cannot be provided sufficiently. On the other hand, with a P amount exceeding about 1.2% by weight, $Fe_3P$, and the like is precipitated along the grain boundary so that the magnetic flux density drastically declines, iron loss increases and processability deteriorates. Accordingly, the range of the P amount is defined to be about 0.2 to 1.2% by weight.

Al: about 2.0% by weight or less, Mn: about 2.0% by weight or less

Al and Mn have the effect of increasing the specific resistivity like P and Si and, thus, are preferable in the present invention. However, an Al or Mn amount exceeding about 2.0% by weight causes the cost to rise.

Therefore, the amount of Al and Mn is preferably about 2.0% by weight or less.

The C and/or O amount is preferably restrained to about a 0.01% by weight or less level to enhance the subsequent cold rolling and punching properties.

Since C deteriorates the magnetic properties, it is advantageous to minimize the amount thereof, specifically, it is more preferable to be about 0.005% by weight or less. Similarly, if O is contained in a large amount, since a bad influence is cast on the formation of a texture integrated in {100}<001> orientation in the hot rolling, and further, the texture and the magnetic properties of the product are deteriorated, it is more preferable to restrain the amount to of oxygen about 0.005% by weight or less.

Sb: about 0.1% by weight or less, Sn: about 0.1% by weight or less.

Since Sb and Sn improve the texture and are effective in improving the magnetic properties, at least one of Sb and Sn can be added optionally as needed.

Concerning the crystal integration degree, the ratio of the {100}<001> integration degree to the {111}<uvw> integration degree is about 2.0 or more.

Here the {100}<001> integration degree represents the value of the three-dimensional orientation density in the {100}<001> orientation, and the {111}<uvw> integration degree represents the geometric mean of the three dimensional orientation density in the {111}<uvw> orientation.

The reason why the above-mentioned ratio is about 2.0 or more is that good properties cannot be obtained with a smaller ratio since the ratio of {111}<uvw> oriented grains, which adversely affects the magnetic characteristics of the sheet, becomes large.

Concerning the crystal grain size, each crystal grain size is from about 10 μm to 500 μm. The crystal grains are obtained by etching with Nitol (a liquid mixture of nitric acid and ethyl alcohol). By measuring the average grain area by microscopic observation, the size corresponding to the circle equivalent diameter may be used as the grain size.

The reason for controlling the upper limit and the lower limit of the crystal grain size at about 10 to 500 μm is that the hysteresis loss is increased to deteriorate the magnetic properties with a crystal grain size less than about 10 μm. On the other hand, the punching property of the product is deteriorated with a crystal grain size exceeding about 500 μm.

Furthermore, concerning the texture, since the texture integrated in the {100}<001> orientation is characteristic of the present invention, it is important to have a {100}<001> integration degree of about 100 or more in order to sufficiently utilize the effect as an Si steel material. Since the integration in the {111}<uvw> orientation, which is disadvantageous in terms of the magnetic properties, becomes strong in an Si steel, the above-mentioned integration degree is necessary.

Further, in a P steel, it is important to have an integration degree in the {100}<001> orientation of about 3 or more. Since the integration in the {111}<uvw> orientation is not particularly strong in a P steel, the above-mentioned integration degree is sufficient.

An electromagnetic steel sheet of the present invention can be obtained by the following method. That is, in the production of an electromagnetic steel sheet by hot rolling a slab with the steel composition adjusted to have about a specific resistivity of 15 μΩ·cm or more specific resistivity in the product, a sufficient strain is applied throughout a predetermined temperature range in the vicinity of the hot rolling final stage. The disclosure of application of sufficient strain refers to rolling with a reduction ratio that is larger than that of an ordinary hot rolling. That is, recrystallization is not generated until midway through the hot rolling, treatment but is drastically applied in the vicinity of the hot rolling final stage under a large strain. This is one of the most important features of the present invention.

A sufficient strain is introduced into the steel sheet so that the rolling texture of the sheet can be effectively improved to obtain a preferable texture. That is, a texture having a higher integration degree in the vicinity of {100}<001> can be obtained compared with the texture obtained by ordinary rolling and, thus, the texture in the hot rolling stage provides excellent characteristics in the product electromagnetic steel sheet. Accordingly, without the need of strictly controlling the cold rolling condition or the annealing condition after hot rolling, a product having excellent electromagnetic properties can be obtained. An example of a further specific hot rolling condition will be described later.

The reduction ratio in the latter stage stand in hot finish rolling specifically needs to be about a 30% or more reduction ratio in the final pass, or about a 10% or more reduction ratio in the final pass and about a 50% or more total reduction ratio in the final 3 passes.

Application of a sufficient amount of a strain energy to the steel sheet in the latter stage of hot finish rolling is important in the present use of, with less than about a 30% reduction ratio in the final pass, or less than about a 50% total reduction ratio in the final 3 passes when the reduction ratio in the final pass is from about 10% to less than about 30%, does not introduce a sufficient strain into its steel sheet and, thus, the rolling texture cannot be improved effectively. Therefore, even if cold rolling and annealing are applied under ordinary conditions in the rolled texture state, improvement of the magnetic properties cannot be expected.

Accordingly, the reduction ratio in the final pass is defined to be about 30% or more, and the total reduction ratio in the final 3 passes is defined to be about 50% or more and the reduction ratio in the final pass is about 10% or more, in hot finish rolling in the present invention. Furthermore, it is particularly preferable to control the finish rolling to have about a 30% or more 1 pass reduction ratio.

The upper limit of the total reduction ratio in the final pass and the final 3 passes is preferably about 80% and about 90%, respectively, since a total reduction ratio in the final pass and in the final 3 passes exceeding about 80% or about 90% deteriorates the production of the steel sheet and the production cost.

Concerning the above-mentioned certain temperature in the vicinity of the hot rolling final stage, the hot rolling finishing temperature is set to be about 750 to 1150° C. With less than about 750° C., the {100}<001> integration degree is less than about 10. On the other hand, at more than about 1150° C., the time from removal from the heating furnace to rolling is limited, and heating at a high temperature is required the cost is raised. Therefore, the rolling temperature is defined in the range from about 750 to 1150° C.

The optimum range of the temperature of the steel sheet at the time of finishing rolling and the reduction ratio varies depending upon the component and, thus, it is advantageous to conduct control according thereto.

As the reason, the phase condition of the steel at the time of finishing rolling seems to be important. That is, a steel sheet having the γ single phase at the time of finishing rolling has a random orientation distribution subsequently so as to influence the texture of the steel sheet produced after subsequent processes and, thus, the {100}<001> integration degree and the magnetic flux density are deteriorated. Therefore, it is important to control the α single phase or the (α+γ) two phase region at the time of finishing rolling.

The {100}<001> integration degree of the steel sheet produced after subsequent processes becomes less than about 10 if the hot rolling finishing temperature is less than $Ar_1$-100° C. in a steel having the ferrite-austenite transformation in the temperature range from about 750 to 1150° C. On the other hand, the texture becomes random if the temperature exceeds $Ar_1$+50° C. Therefore, it is preferable to form the finish rolling in the temperature range from $Ar_1$-100° C. to $Ar_1$+50° C.

In a steel having the ferrite single phase in the temperature range from about 750 to 1150° C., sufficient characteristics cannot always be by only satisfying the above-mentioned rolling temperature and reduction ratio. The reason is that the hot rolling strain amount at a high temperature, which is necessary for forming the texture oriented in {100}<001>, increases with a large Si content. Therefore, in this case, it is important to conduct hot finish rolling by satisfying the below-mentioned formula with respect to the final stand reduction ratio (1 pass) R (%), the rolling finishing temperature $T_F$, and the Si amount [Si]:

$$1150 \geqq T_F \geqq 1010+100\times[\mathrm{Si}]-5\times R.$$

By further conducting cold rolling and annealing after the above-mentioned hot finish rolling, a cold rolled electromagnetic steel sheet having excellent magnetic properties can be obtained. Specifically, the reduction ratio is selected during cold rolling so as not to ruin the preferable texture obtained in the hot rolling, and even preferably to further improve the texture. Since the texture is disturbed and deteriorates the integration degree with a more than about 90% cold reduction ratio, it is preferably about 90% or less. Even with a low cold reduction ratio, the magnetic characteristics cannot be worse than that of the hot rolled steel sheet. However, in order to improve the same, about a 40% or more reduction ratio is preferable. By selecting the cold reduction ratio in the range from about 40 to 90%, better characteristics including a high {100}<001> integration degree and the magnetic properties such as about 1.80 T or more $B_{50}$ at 2 to 3 W/kg of $W_{15/50}$, and about 1.86 T or more $B_{50}$ at 3 to 4 W/kg of $W_{15/50}$ can be provided.

Hot rolled sheet annealing can be conducted as needed. The upper limit of the temperature is defined to be about 1100° C. or less in view of production cost, or the $A_1$ transformation point or less in the case of the steel to be transformed. On the other hand, since the effect of annealing cannot be provided of less than about 600° C., it is preferable to have the lower limit at about 600° C.

The conditions of the finish annealing need not be particularly limited. However, a condition about 750 to 1100° C. temperature range for about 10 seconds to 2 hours is recommended. In particular, since the texture becomes random and, thus, a desired texture cannot be obtained in the steel to be transformed if the annealing temperature exceeds the Al transformation point, it is preferable to use finish annealing at lower than the $A_1$ transformation point.

The description is simply intended to illustrative examples of embodiments of the present invention various modifications can be introduced within the ranges of the appended claims.

EXAMPLES

Example 1

100 kg steel ingots with compositions shown in Table 2 were melted in a small vacuum melting furnace, and sheet bars with a 1.5 to 8.0 mm thickness were obtained by hot rough rolling after heating at 1150° C. After being heated at 1100° C., the steel sheet bars were rolled at a 800 m/min rolling speed with the rolling finishing temperature controlled at 700, 750, 950, and 1050° C. so as to obtain a 1.0 mm thickness by 1 pass. Then, a heat treatment was applied at 750° C. for 2 hours. The heat treatment is for self annealing by the coil winding process. After being washed with acid, the hot rolled steel sheets were cold rolled so as to have a 0.35 mm thickness. Then, finish annealing was applied at 850° C. for 1 minute.

The pole figure of (110), (200), and (211) of each of the steel sheets accordingly obtained was sought by X-ray diffraction. Three dimensional orientation analysis was conducted using a series development method mentioned above. The magnetic measurement was conducted with a specimen with the L direction and a specimen with the C direction combined half and half for seeking the iron loss amount at the time of 1.5 T excitation; $W_{15/50}$, and the magnetic flux density; $B_{50}$ at the time of the excited magnetic field; 5000 A/m. Concerning the magnetic flux density, each $B_{50}$ in the L direction and the C direction was measured so as to seek the difference $\Delta B_{50}$ between the L direction and the C direction.

The obtained results are shown in Table 3.

TABLE 2

| Kind of steel | C (%) | Si (%) | Mn (%) | P (%) | S (%) | Al (%) | N (ppm) | O (ppm) | $Ar_1$ point (° C.) | Specific resistivity ρ (μΩ · cm) |
|---|---|---|---|---|---|---|---|---|---|---|
| I | 0.005 | 0.45 | 0.25 | 0.005 | 0.001 | 0.25 | 23 | 24 | 892 | 19 |
| II | 0.004 | 1.03 | 0.23 | 0.25 | 0.001 | 0.21 | 16 | 18 | 925 | 26 |
| III | 0.004 | 3.1 | 0.24 | 0.001 | 0.001 | 0.60 | 8 | 9 | — | 54 |
| IV | 0.003 | 3.8 | 0.21 | 0.001 | 0.001 | 0.045 | 10 | 12 | — | 56 |

TABLE 3

| No. | Kind of steel | Reduction ratio R (%) | Rolling finishing temperature $T_F$ (° C.) | {100}<001> integration degree | {111}<uvw> integration degree | {100} <001> integration degree / {111} <uvw> integration degree | $W_{15/50}$ (W/kg) (L + C) | $B_{50}$ (T) (L + C) | $\Delta B_{50}$(T) ($B_{50L}$ − $B_{50C}$) | Remark |
|---|---|---|---|---|---|---|---|---|---|---|
| 1 | I | 75 | 700 | 2.89 | 3.32 | 0.87 | 5.84 | 1.76 | 0.10 | Comparative Example |
| 2 | I | 27 | 750 | 2.58 | 2.13 | 1.21 | 5.34 | 1.75 | 0.12 | Comparative Example |
| 3 | I | 50 | 750 | 11.23 | 4.42 | 2.54 | 5.12 | 1.85 | 0.03 | This invention |
| 4 | I | 80 | 750 | 15.26 | 2.24 | 6.81 | 5.15 | 1.86 | 0.02 | This invention |
| 5 | II | 75 | 700 | 3.45 | 2.50 | 1.38 | 4.54 | 1.75 | 0.09 | Comparative Example |
| 6 | II | 27 | 950 | 1.93 | 1.54 | 1.25 | 4.82 | 1.76 | 0.15 | Comparative Example |
| 7 | II | 80 | 950 | 15.23 | 1.64 | 9.29 | 4.32 | 1.84 | 0.04 | This invention |
| 8 | III | 75 | 700 | 1.82 | 1.73 | 1.05 | 2.15 | 1.69 | 0.13 | Comparative Example |
| 9 | III | 80 | 950 | 12.54 | 0.82 | 15.29 | 1.98 | 1.79 | 0.05 | This invention |
| 10 | III | 80 | 1050 | 24.21 | 0.96 | 25.22 | 1.89 | 1.80 | 0.03 | This invention |
| 11 | IV | 75 | 700 | 1.30 | 2.00 | 0.65 | 2.05 | 1.66 | 0.15 | Comparative Example |
| 12 | IV | 80 | 1050 | 1.80 | 2.46 | 0.73 | 1.98 | 1.62 | 0.18 | Comparative Example |

Nos. 1, 5 and 8 are comparative examples with a low rolling temperature. Nos. 2 and 6 are Comparative Examples with the reduction ratio outside the range of the present invention. In both of them, the {100}<001> integration degree is less than the targeted value, the magnetic properties, particularly the magnetic flux density are poor, and the difference between the L direction and the C direction is large.

Nos. 11 and 12 are comparative examples with the Si amount outside the range of the present invention. Even if the rolling condition is in the preferable range (No. 12), the magnetic flux density is poor, and the difference between the L direction and the C direction is large.

On the other hand, examples of the present invention in Nos. 3, 4, 7, 9 and 10 have a 10 or more {100}<001> integration degree, and excellent magnetic properties with a small difference between the L direction and the C direction.

Example 2

50 kg steel ingots with a composition including 0.53% by weight of Si and Fe substantially in the remainder (kind of the steel in Table 4: A), and with a composition including 1.21% by weight of Si and Fe substantially in the remainder (kind of the steel in Table 4: B) were melted in a small vacuum melting furnace, and sheet bars with a 1.2 to 8.0 mm thickness were obtained by hot rough rolling after heating at 1150° C. After being heated at 1100° C., the steel sheet bars were rolled by a 800 m/min rolling speed with the rolling finishing temperature controlled between 700 to 1050° C. so as to obtain a 1.0 mm thickness by 1 pass. Then, a hot rolled sheet annealing was applied at 800° C. for 10 minutes. After being washed with acid, the steel sheets were cold rolled so as to have a 0.35 thickness. Then, finish annealing was applied at 850° C. for 1 minute.

The three dimensional orientation distribution density, $W_{15/50}$, and $B_{50}$ of the accordingly obtained steel sheets were calculated as in Example 1.

The obtained results are shown in Table 4.

TABLE 4

| No. | Kind of steel | Reduction ratio R (%) | Rolling finishing temperature (Relative temperature with respect to the $Ar_1$ point) (° C.) | $Ar_1$ transformation temperature (° C.) | {100}<001> integration degree | {111}<uvw> integration degree | {100} <001> integration degree / {111} <uvw> integration degree | $W_{15/50}$ (W/kg) | $B_{50}$ (T) | Remark |
|---|---|---|---|---|---|---|---|---|---|---|
| 1 | A | 60 | −120 | 897 | 2.34 | 1.90 | 1.23 | 5.23 | 1.78 | Comparative Example |
| 2 | A | 85 | −120 | 897 | 4.56 | 2.50 | 1.82 | 5.12 | 1.77 | Comparative Example |
| 3 | A | 50 | −95 | 897 | 12.57 | 2.75 | 4.57 | 5.05 | 1.85 | This invention |
| 4 | A | 27 | −30 | 897 | 1.83 | 1.86 | 0.98 | 5.32 | 1.76 | Comparative Example |

TABLE 4-continued

| No. | Kind of steel | Reduction ratio R (%) | Rolling finishing temperature (Relative temperature with respect to the $Ar_1$ point) (° C.) | $Ar_1$ transformation temperature (° C.) | {100}<001> integration degree | {111}<uvw> integration degree | {100} <001> integration degree / {111} <uvw> integration degree | $W_{15/50}$ (W/kg) | $B_{50}$ (T) | Remark |
|---|---|---|---|---|---|---|---|---|---|---|
| 5 | A | 70 | −30 | 897 | 20.32 | 1.49 | 13.63 | 5.08 | 1.85 | This invention |
| 6 | A | 75 | 48 | 897 | 22.13 | 1.03 | 21.48 | 4.98 | 1.86 | This invention |
| 7 | A | 27 | 63 | 897 | 1.92 | 2.02 | 0.95 | 5.12 | 1.71 | Comparative Example |
| 8 | A | 85 | 63 | 897 | 4.21 | 3.11 | 1.35 | 5.24 | 1.73 | Comparative Example |
| 9 | B | 80 | −110 | 935 | 2.03 | 1.99 | 1.02 | 4.56 | 1.76 | Comparative Example |
| 10 | B | 75 | −90 | 935 | 13.54 | 0.73 | 18.54 | 4.23 | 1.84 | This invention |
| 11 | B | 80 | −50 | 935 | 19.84 | 0.78 | 25.43 | 4.25 | 1.85 | This invention |
| 12 | B | 80 | 40 | 935 | 23.54 | 1.91 | 12.32 | 4.15 | 1.85 | This invention |
| 13 | B | 80 | 55 | 935 | 1.04 | 1.96 | 0.53 | 4.42 | 1.69 | Comparative Example |

Nos. 1, 2 and 9 are comparative examples with a low rolling temperature. In either of them, the {100}<001> integration degree is less than the targeted value, and the magnetic properties are drastically deteriorated.

Nos. 7, 8 and 13 are comparative examples with a high rolling temperature. The {100}<001> integration degree is low, the orientation is random, and the magnetic properties are deteriorated.

No. 4 is an example with a low rolling ratio, where satisfactory magnetic properties are not obtained.

On the other hand, examples of the present invention in Nos. 3, 5, 6, 10, 11 and 12 have a 10 or more {100}<001> integration degree, and excellent magnetic properties.

Example 3

50 kg steel ingots with compositions shown in Table 5 were melted in a small vacuum melting furnace. In Table 5, the steels (C), (D) and (E) are of a composition ratio according to the present invention. The steel (D) contains P alone, the steels (C) and (E) contain Si, Al and Mn added thereto. The steels (A) and (B) are comparative examples with an ordinary silicon steel sheet composition. Furthermore, the steel (F) is an example with the Si, Al and Mn amount outside the range of the present invention.

After heating the steel ingots at 1150° C., sheet bars having a 1.1 to 4.0 mm thickness were obtained by hot rough rolling. After being heated at 1100° C., the steel sheet bars were rolled by a 800 m/min rolling speed with the rolling finishing temperature controlled between 600 to 950° C. so as to obtain a 0.8 mm thickness by 1 pass (reduction ratio: 27 to 80%). Then, a heat treatment was applied at 750° C. for 2 hours, and further, a heat treatment was applied at 950° C. for 1 minute. The former heat treatment is for self annealing by coil winding.

The (110), (200), (211) pole figure of each of the hot rolled steel sheets accordingly obtained was sought by the X-ray diffraction, and the three dimensional orientation analysis was conducted using the above-mentioned series development method so as to seek the three dimensional orientation distribution density. The magnetic measurement was further conducted to seek the iron loss value $W_{15/50}$ at the time of the 1.5 T excitation and the magnetic flux density $B_{50}$ at the time of the excited magnetic field 5000 A/m.

The obtained results are shown in Table 6.

TABLE 5

| Kind of steel | C (wt %) | Si (wt %) | Mn (wt %) | P (wt %) | S (wt %) | Al (wt %) | N (ppm) | O (ppm) | Specific resistivity ρ (μΩ · cm) | Remark |
|---|---|---|---|---|---|---|---|---|---|---|
| (A) | 0.003 | 3.05 | 0.22 | 0.001 | 0.001 | 0.50 | 18 | 12 | 52 | Comparative Example |
| (B) | 0.004 | 1.04 | 0.25 | 0.001 | 0.001 | 0.21 | 16 | 20 | 25 | Comparative Example |
| (C) | 0.002 | 0.23 | 0.22 | 0.320 | 0.001 | 0.35 | 10 | 13 | 23 | This invention |
| (D) | 0.001 | 0.02 | 0.05 | 0.680 | 0.001 | 0.03 | 11 | 10 | 22 | This invention |
| (E) | 0.001 | 1.55 | 0.20 | 0.490 | 0.001 | 0.33 | 9 | 8 | 41 | This invention |
| (F) | 0.004 | 2.53 | 0.22 | 0.420 | 0.001 | 2.80 | 16 | 10 | 77 | Comparative Example |

TABLE 6

| No. | Kind of steel R | Reduction ratio (%) | Rolling finishing temperature $T_F$ (° C.) | {100}<001> integration degree | {100}<uvw> integration degree | {100} <001> integration degree / {111} <uvw> integration degree | Magnetic properties in the L direction $W_{15/50}$ (W/kg) | Magnetic properties in the L direction $B_{50}$ (T) | Magnetic properties in the C direction $W_{15/50}$ (W/kg) | Magnetic properties in the C direction $B_{50}$ (T) | Remark |
|---|---|---|---|---|---|---|---|---|---|---|---|
| 1 | (A) | 27 | 700 | 1.9 | 1.5 | 1.3 | 3.24 | 1.74 | 3.38 | 1.69 | Comp. Ex. |
| 2 | (B) | 27 | 700 | 2.1 | 1.3 | 1.6 | 5.51 | 1.79 | 5.89 | 1.74 | Comp. Ex. |
| 3 | (B) | 80 | 950 | 5.3 | 2.2 | 2.4 | 5.42 | 1.82 | 5.47 | 1.80 | Comp. Ex. |
| 4 | (C) | 80 | 950 | 4.7 | 0.5 | 9.4 | 4.78 | 1.85 | 4.85 | 1.83 | This invention |
| 5 | (D) | 80 | 950 | 4.9 | 0.4 | 12.3 | 5.17 | 1.88 | 5.30 | 1.85 | This invention |
| 6 | (D) | 60 | 950 | 4.2 | 0.7 | 6.0 | 5.33 | 1.85 | 5.46 | 1.83 | This invention |
| 7 | (D) | 27 | 950 | 2.4 | 1.3 | 1.8 | 5.41 | 1.84 | 5.59 | 1.79 | Comp. Ex. |
| 8 | (D) | 80 | 800 | 4.5 | 0.5 | 9.0 | 5.30 | 1.85 | 5.41 | 1.82 | This invention |
| 9 | (D) | 80 | 600 | 2.0 | 2.4 | 0.8 | 5.25 | 1.85 | 5.50 | 1.78 | Comp. Ex. |
| 10 | (E) | 80 | 950 | 4.5 | 1.2 | 3.8 | 3.33 | 1.78 | 3.36 | 1.76 | This invention |
| 11 | (F) | 80 | 950 | 3.3 | 1.6 | 2.1 | 3.27 | 1.62 | 3.41 | 1.55 | Comp. Ex. |

Nos. 1 to 3 are comparative examples of an ordinary silicon steel sheet composition. As can be seen from the comparison between Nos. 1 and 2, in general, with the alloy amount increased, the iron loss is reduced but the magnetic flux density is declined as well.

No. 3 is a comparative example with a conventional silicon steel composition although the rolling condition is fit to the present invention. In No. 3, the {100}<001> integration degree is higher due to rolling at a high temperature and a large reduction. As a result, the magnetic properties in the C direction are particularly improved compared to Nos. 1 and 2.

On the other hand, examples of the present invention in Nos. 4 and 5 with the rolling condition the same as No. 3, have a high magnetic flux density particularly in the magnetic properties in the C direction compared to the No. 3, which has the similar iron loss value. That is, the steel sheets Nos. 4 and 5 with the rolling condition and the composition according to the present invention have excellent characteristics including a low iron loss in the C direction and a particularly high magnetic flux density compared with the steel sheet No. 3 with a conventional composition obtained in the rolling condition of the present invention. The same can be applied to Nos. 6 and 8 according to the present invention.

No. 10 is an example of the present invention containing Si and Al in addition to P. In this case, a particularly high magnetic flux density is achieved in the similar iron loss level compared with the conventional comparative example No. 1.

On the other hand, since the rolling condition of Nos. 7 and 9 is outside the range of the present invention although the composition ratio is in the range of the present invention, the characteristics are at a similar level as No. 3 although they are better than the characteristics of No. 2 with a conventional composition. Since the total amount of Si, Al and Mn of No. 11 exceeds the range of the present invention, it cannot exceed the conventional level of the magnetic properties.

Example 4

50 kg steel ingots with compositions shown in Table 5 were melted in a small vacuum melting furnace. After heating the steel ingots at 1150° C., sheet bars having a 1.1 to 4.0 mm thickness were obtained by hot rough rolling. After being heated at 1100° C., the steel sheet bars were rolled at a 800 m/min rolling speed with the rolling finishing temperature controlled between 600 to 950° C. so as to obtain a 0.8 mm thickness by 1 pass (reduction ratio: 27 to 80%). Then, the scale on the hot rolled sheet surface was eliminated by a shot blast treatment. Cold rolling was conducted to have a 0.5 mm thickness. Annealing was applied at 850° C. for 1 minute in an atmosphere containing 35% of hydrogen and 65% of nitrogen.

The (110), (200), (211) pole figure of each of the cold rolled steel sheets accordingly obtained was sought by X-ray diffraction, and the three dimensional orientation analysis was conducted using the above-mentioned series development method so as to seek the three dimensional orientation distribution density. The magnetic measurement was further conducted to seek the iron loss value $W_{15/50}$ at the time of the 1.5 T excitation and the magnetic flux density $B_{50}$ at the time of the excited magnetic field 5000 A/m.

The obtained results are shown in Table 7.

TABLE 7

| No. | Kind of steel | Hot reduction ratio R (%) | Hot rolling finishing temperature $T_F$ (° C.) | {100}<001> integration degree in the cold rolled steel | {111}<uvw> integration degree | {100} <001> integration degree / {111} <uvw> integration degree | Magnetic properties in the L direction $W_{15/50}$ (W/kg) | Magnetic properties in the L direction $B_{50}$ (T) | Magnetic properties in the C direction $W_{15/50}$ (W/kg) | Magnetic properties in the C direction $B_{50}$ (T) | Remark |
|---|---|---|---|---|---|---|---|---|---|---|---|
| 1 | (A) | 27 | 700 | 1.5 | 1.3 | 1.2 | 2.35 | 1.73 | 2.59 | 1.66 | Comp. Ex. |
| 2 | (B) | 27 | 700 | 1.7 | 1.3 | 1.3 | 4.48 | 1.77 | 4.79 | 1.71 | Comp. Ex. |
| 3 | (B) | 80 | 950 | 4.8 | 1.5 | 3.2 | 4.44 | 1.81 | 4.49 | 1.78 | Comp. Ex. |
| 4 | (C) | 80 | 950 | 5.0 | 0.6 | 8.3 | 3.65 | 1.86 | 3.75 | 1.84 | This invention |

TABLE 7-continued

| No. | Kind of steel | Hot reduction ratio R (%) | Hot rolling finishing temperature $T_F$ (° C.) | {100}<001> integration degree in the cold rolled steel | {111}<uvw> integration degree | {100} <001> integration degree / {111} <uvw> integration degree | Magnetic properties in the L direction $W_{15/50}$ (W/kg) | Magnetic properties in the L direction $B_{50}$ (T) | Magnetic properties in the C direction $W_{15/50}$ (W/kg) | Magnetic properties in the C direction $B_{50}$ (T) | Remark |
|---|---|---|---|---|---|---|---|---|---|---|---|
| 5 | (D) | 80 | 950 | 5.7 | 0.5 | 11.4 | 3.59 | 1.87 | 3.70 | 1.85 | This invention |
| 6 | (D) | 60 | 950 | 5.5 | 0.6 | 9.2 | 3.64 | 1.84 | 3.77 | 1.82 | This invention |
| 7 | (D) | 27 | 950 | 1.9 | 2.1 | 0.9 | 3.76 | 1.83 | 3.98 | 1.78 | Comp. Ex. |
| 8 | (D) | 80 | 800 | 4.8 | 0.5 | 9.6 | 3.61 | 1.84 | 3.73 | 1.82 | This invention |
| 9 | (D) | 80 | 600 | 1.6 | 1.4 | 1.1 | 3.77 | 1.82 | 4.02 | 1.74 | Comp. Ex. |
| 10 | (E) | 80 | 950 | 6.1 | 0.5 | 12.2 | 2.25 | 1.80 | 2.31 | 1.78 | This invention |
| 11 | (F) | 80 | 950 | 3.9 | 3.2 | 1.2 | 2.22 | 1.65 | 2.40 | 1.56 | Comp. Ex. |

Comp. Ex.: Comparative Example

Nos. 1 to 3 are comparative examples of an ordinary silicon steel sheet composition. As can be seen from the comparison between Nos. 1 and 2, in general, with the alloy amount increased, the iron loss is reduced but the magnetic flux density declined as well.

No. 3 is a comparative example with a conventional silicon steel composition although the rolling condition is fit to the present invention. In No. 3, the {100}<001> integration degree is higher due to rolling at a high temperature and a large reduction. As a result, particularly the magnetic properties in the C direction are improved compared with Nos. 1 and 2.

On the other hand, examples of the present invention in Nos. 4 and 5 with the rolling condition the same as No. 3, have a high magnetic flux density particularly in the magnetic properties in the C direction compared with the No. 3, which has the similar iron loss value. That is, the steel sheets Nos. 4 and 5 with the rolling condition and the composition according to the present invention have excellent characteristics including a low iron loss in the C direction and a particularly high magnetic flux density compared with the steel sheet No. 3 with a conventional composition obtained in the rolling condition of the present invention. The same can be applied to Nos. 6 and 8 according to the present invention.

No. 10 is an example of the present invention containing Si and Al in addition to P. In this case, a particularly high magnetic flux density is achieved in the similar iron loss level compared with the conventional comparative example No. 1.

On the other hand, since the rolling condition of Nos. 7 and 9 is outside the range of the present invention although the composition ratio is in the range of the present invention, the characteristics are at a similar level as No. 3 although they are better than the characteristics of No. 2 with a conventional composition. Since the total amount of Si, Al and Mn of No. 11 exceeds the range of the present invention, it cannot exceed the conventional level of the magnetic properties.

Example 5

An example with a higher cold reduction ratio for obtaining further better magnetic properties will be described.

50 kg steel ingots with compositions shown in Table 5 were heated at 1150° C. so as to obtain sheet bars having a 1.7 to 6.2 mm thickness by hot rough rolling. After being heated at 1100° C., the steel sheet bars were rolled at a 800 m/min rolling speed with the rolling finishing temperature controlled between 600 to 950° C. so as to obtain a 1.25 mm thickness finish hot rolled sheet with 1 pass (reduction ratio: 26 to 80%). Then, the scale was eliminated by applying a shot on the surface of the finish hot rolled sheet. Cold rolling was conducted to have a 0.5 mm thickness with a 60% reduction ratio. Annealing was applied at 850° C. for 1 minute in an atmosphere containing 35% of hydrogen and 65% of nitrogen.

The (110), (200), (211) pole figure of each of the electromagnetic steel sheets accordingly obtained was by X-ray diffraction, and the three dimensional orientation analysis was conducted using the above-mentioned series development method so as to obtain the three dimensional orientation distribution density. The magnetic measurement was further conducted to obtain the iron loss value $W_{15/50}$ at the time of the 1.5 T excitation and the magnetic flux density $B_{50}$ at the time of the excited magnetic field 5000 A/m.

The obtained results are shown in Table 8.

TABLE 8

| No. | Kind of steel | Hot reduction ratio R (%) | Rolling finishing temperature $T_F$ (° C.) | {100}<001> integration degree | {111}<uvw> integration degree | {100} <001> integration degree / {111} <uvw> integration degree | Magnetic properties in the L direction $W_{15/50}$ (W/kg) | Magnetic properties in the L direction $B_{50}$ (T) | Magnetic properties in the C direction $W_{15/50}$ (W/kg) | Magnetic properties in the C direction $B_{50}$ (T) | Remark |
|---|---|---|---|---|---|---|---|---|---|---|---|
| 1 | (A) | 26 | 700 | 1.2 | 1.3 | 0.92 | 2.33 | 1.77 | 2.61 | 1.65 | Comp. Ex. |
| 2 | (B) | 26 | 700 | 1.3 | 1.1 | 1.2 | 4.33 | 1.80 | 4.79 | 1.72 | Comp. Ex. |
| 3 | (B) | 80 | 950 | 11.2 | 0.9 | 12 | 4.34 | 1.88 | 4.40 | 1.85 | Comp. Ex. |

TABLE 8-continued

| No. | Kind of steel | Hot reduction ratio R (%) | Rolling finishing temperature $T_F$ (° C.) | {100}<001> integration degree | {111}<uvw> integration degree | {100} <001> integration degree / {111} <uvw> integration degree | Magnetic properties in the L direction $W_{15/50}$ (W/kg) | Magnetic properties in the L direction $B_{50}$ (T) | Magnetic properties in the C direction $W_{15/50}$ (W/kg) | Magnetic properties in the C direction $B_{50}$ (T) | Remark |
|---|---|---|---|---|---|---|---|---|---|---|---|
| 4 | (C) | 80 | 950 | 12.4 | 0.9 | 14 | 3.60 | 1.90 | 3.63 | 1.88 | This invention |
| 5 | (D) | 80 | 950 | 13.0 | 0.8 | 16 | 3.57 | 1.91 | 3.61 | 1.89 | This invention |
| 6 | (D) | 60 | 950 | 9.9 | 0.8 | 12 | 3.55 | 1.89 | 3.65 | 1.87 | This invention |
| 7 | (D) | 26 | 950 | 6.2 | 3.2 | 1.9 | 3.66 | 1.87 | 3.80 | 1.84 | Comp. Ex. |
| 8 | (D) | 80 | 800 | 7.5 | 0.9 | 8.3 | 3.53 | 1.89 | 3.67 | 1.86 | This invention |
| 9 | (D) | 80 | 600 | 5.9 | 3.2 | 1.8 | 3.69 | 1.89 | 3.88 | 1.82 | Comp. Ex. |
| 10 | (E) | 80 | 950 | 11.0 | 0.8 | 14 | 1.98 | 1.87 | 2.04 | 1.83 | This invention |
| 11 | (F) | 80 | 950 | 8.5 | 4.4 | 1.9 | 1.90 | 1.78 | 2.11 | 1.70 | Comp. Ex. |

Comp. Ex.: Comparative Example

Nos. 1 to 3 are comparative examples of an ordinary silicon steel sheet composition. As can be seen from the comparison between Nos. 1 and 2, in general, with the alloy amount increased, the iron loss is reduced but the magnetic flux density declined as well.

No. 3 is a comparative example with a conventional silicon steel composition although the rolling condition is fit to the present invention. In No. 3, the {100}<001> integration degree is higher due to rolling at a high temperature and a large reduction. As a result, the magnetic properties in the C direction are particularly improved compared with Nos. 1 and 2.

On the other hand, examples of the present invention in Nos. 4 and 5 with the rolling condition the same as No. 3, have a high magnetic flux density particularly in the magnetic properties in the C direction compared to No. 3, which has a similar iron loss value. That is, the steel sheets Nos. 4 and 5 with the rolling condition and the composition according to the present invention have excellent characteristics including a low iron loss in the C direction and a particularly high magnetic flux density compared to the steel sheet No. 3 with a conventional composition obtained in the rolling condition of the present invention. The same can be applied to Nos. 6 and 8 according to the present invention.

No. 10 is an example of the present invention containing Si and Al in addition to P. In this case, a particularly high magnetic flux density is achieved in the similar iron loss level compared to the conventional comparative example No. 1.

On the other hand, since the rolling condition of Nos. 7 and 9 is outside the range of the present invention although the composition ratio is in the range of the present invention, the characteristics are at a similar level as No. 3 although they are better than the characteristics of No. 2 with a conventional composition. Since the total amount of Si, Al and Mn of No. 11 exceeds the range of the present invention, it cannot exceed the conventional level of the magnetic properties.

Example 6

The influence of the cold reduction ratio will be described.

Sheet bars with a 3.75 to 14 mm thickness were produced using the steel (C) shown in Table 5 by hot rough rolling. After being heated at 1100° C., the steel sheet bars were rolled at a 800 m/min rolling speed with a 950° C. rolling finishing temperature so as to obtain a 0.75 to 7.0 mm thickness with 1 pass (reduction ratio: 50 to 80%).

The scale was eliminated by applying a shot on the surface of the finish hot rolled sheet. Cold rolling was conducted to have a 0.5 mm thickness with a 33 to 63% reduction ratio. Annealing was applied at 850° C. for 1 minute in an atmosphere containing 35% of hydrogen and 65% of nitrogen. Then the evaluation the same as Example 3 was conducted to obtain the results shown in Table 9.

TABLE 9

| No. | Kind of steel | Hot reduction ratio (%) | Cold reduction ratio (%) | {100}<001> integration degree | {111}<uvw> integration degree | {100} <001> integration degree / {111} <uvw> integration degree | Magnetic properties in the L direction $W_{15/50}$ (W/kg) | Magnetic properties in the L direction $B_{50}$ (T) | Magnetic properties in the C direction $W_{15/50}$ (W/kg) | Magnetic properties in the C direction $B_{50}$ (T) | Remark |
|---|---|---|---|---|---|---|---|---|---|---|---|
| 12 | (C) | 80 | 33 | 5.2 | 1.3 | 4.0 | 3.68 | 1.88 | 3.73 | 1.85 | This invention |
| 13 | (C) | 60 | 67 | 10.3 | 0.8 | 12.9 | 3.62 | 1.90 | 3.65 | 1.88 | This invention |
| 14 | (C) | 50 | 93 | 6.0 | 0.7 | 8.6 | 3.75 | 1.86 | 3.82 | 1.83 | This invention |

No. 13 is an example of the present invention with the cold reduction ratio in the preferable range, where the {100}<001> integration degree is high, and the magnetic flux density in the C direction is particularly high.

Since the cold reduction ratio in No. 12 is too low, and the cold reduction ratio in No. 14 too large, the integration degree cannot be large and the magnetic flux density slightly declined in both cases.

Example 7

Steel slabs with composition ratios shown in Table 10 were heated at 1100° C. and rolled by hot rough rolling. With a 5% reduction ratio at the final pass of the hot finish rolling, hot rolled sheets with a 2.0 mm thickness were obtained. The sheets were applied with cold rolling so as to have a 0.5 mm thickness in the cold rolling condition in producing an ordinary non-oriented electromagnetic steel sheet. Then, annealing was applied with the condition the same as mentioned above.

The magnetic measurement was conducted for the electromagnetic steel sheets accordingly obtained by the electromagnetic steel sheet testing method stipulated in the JIS C 2550 for obtaining the iron loss value $W_{15/50}$ per 1 kg with respect to the 1.5 tesla (T) maximum magnetic flux density and a 50 Hz frequency, and the magnetic flux density $B_{50}$ at a 5000 A/m magnetic force. The results are shown in Table 11.

As is apparent from Table 11, the examples of the present invention have magnetic properties superior to those of the conventional examples in any kind of steel.

Example 8

A steel slab containing 1.24% by weight of Si (kind of the steel: A), a steel slab containing 3.46% by weight of Si (kind of the steel: B), and a steel slab containing 3.80% by weight of Si (kind of the steel: C) were heated at 1120° C. and rolled by hot rough rolling. With the conditions shown in Table 12 in terms of a total reduction ratio in the final 3 passes and a reduction ratio in the final pass, hot finish rolling was applied for obtaining hot rolled sheets with a 1.2 mm thickness. The sheets were applied with hot rolled sheet annealing at 900° C. for 2 minutes. The scale was eliminated by washing with acid. Then cold rolling was applied so as to have a 0.5 mm thickness. Then, finish annealing at 850° C. for 20 seconds in an atmosphere containing hydrogen and nitrogen.

In any of the steel kinds A to C, the amount of C, Al, and Mn was adjusted to the preferable range of the present invention.

The magnetic measurement was conducted for the electromagnetic steel sheets accordingly obtained in the method the same as Example 1 for obtaining the iron loss value $W_{15/50}$ and the magnetic flux density $B_{50}$. The results are shown in Table 12.

TABLE 10

| Kind of steel | Composition ratio (wt %) | | | | | | | | | Specific resistivity ρ |
|---|---|---|---|---|---|---|---|---|---|---|
| | C | Si | Al | Mn | S | N | O | Sb | Sn | (μΩ · cm) |
| 1 | 0.003 | 0.12 | 0.31 | 0.31 | 0.002 | 0.003 | 0.003 | — | — | 17 |
| 2 | 0.005 | 0.54 | 0.25 | 0.29 | 0.002 | 0.004 | 0.004 | — | — | 21 |
| 3 | 0.002 | 1.01 | 0.21 | 0.24 | 0.001 | 0.003 | 0.003 | — | — | 25 |
| 4 | 0.003 | 1.17 | 0.23 | 0.26 | 0.001 | 0.003 | 0.003 | — | — | 28 |
| 5 | 0.003 | 1.45 | 0.21 | 0.25 | 0.002 | 0.003 | 0.003 | — | — | 31 |
| 6 | 0.002 | 1.84 | 0.22 | 0.25 | 0.001 | 0.003 | 0.003 | — | — | 35 |
| 7 | 0.003 | 1.23 | 0.23 | 0.25 | 0.001 | 0.004 | 0.003 | 0.04 | — | 28 |
| 8 | 0.003 | 1.05 | 0.21 | 0.24 | 0.001 | 0.003 | 0.003 | — | 0.035 | 26 |

TABLE 11

| Kind of steel | $W_{15/50}$ (W/kg) | $B_{50}$ (T) | {100}<001> integration degree | {111}<uvw> integration degree | {100} <001> integration degree / {111} <uvw> integration degree | Remark |
|---|---|---|---|---|---|---|
| 1 | 7.12 | 1.85 | 10.2 | 3.5 | 2.9 | This invention |
| 1 | 7.64 | 1.77 | 2.0 | 3.2 | 0.6 | Conventional example |
| 2 | 6.12 | 1.83 | 11.1 | 4.5 | 2.5 | This invention |
| 2 | 6.48 | 1.75 | 1.8 | 4.2 | 0.4 | Conventional example |
| 3 | 5.35 | 1.82 | 10.0 | 2.1 | 4.8 | This invention |
| 3 | 5.70 | 1.73 | 2.2 | 3.2 | 0.7 | Conventional example |
| 4 | 4.23 | 1.80 | 12.3 | 2.0 | 6.2 | This invention |
| 4 | 4.56 | 1.72 | 1.5 | 1.8 | 0.8 | Conventional example |
| 5 | 3.58 | 1.78 | 11.3 | 2.3 | 4.9 | This invention |
| 5 | 3.98 | 1.71 | 1.7 | 1.5 | 1.1 | Conventional example |
| 6 | 2.56 | 1.76 | 10.7 | 2.6 | 4.1 | This invention |
| 6 | 2.86 | 1.69 | 2.6 | 3.2 | 0.8 | Conventional example |
| 7 | 4.17 | 1.82 | 10.3 | 1.5 | 6.9 | This invention |
| 7 | 4.23 | 1.74 | 1.9 | 0.9 | 2.1 | Conventional example |
| 8 | 4.42 | 1.81 | 10.6 | 1.4 | 7.6 | This invention |
| 8 | 4.67 | 1.73 | 2.3 | 1.2 | 1.9 | Conventional example |

TABLE 12

| No. | Kind of steel | Finish rolling conditions: Total reduction ratio by the final 3 pass (%) | Finish rolling conditions: Reduction ratio by the final pass (%) | Magnetic properties: $W_{15/50}$ (W/kg) | Magnetic properties: $B_{50}$ (T) | {100}<001> integration degree | {111}<uvw> integration degree | {100} <001> integration degree / {111} <uvw> integration degree | Remark |
|---|---|---|---|---|---|---|---|---|---|
| 1 | A | 48 | 35 | 4.52 | 1.85 | 10.0 | 1.9 | 5.3 | This invention |
| 2 | A | 50 | 33 | 4.56 | 1.84 | 12.1 | 2.1 | 5.8 | This invention |
| 3 | A | 38 | 10 | 4.72 | 1.78 | 2.5 | 2.8 | 0.9 | Comparative example |
| 4 | A | 58 | 15 | 4.43 | 1.82 | 11.3 | 4.2 | 2.7 | This invention |
| 5 | A | 45 | 8 | 4.59 | 1.76 | 1.9 | 3.1 | 0.6 | Comparative example |
| 6 | B | 47 | 31 | 3.95 | 1.80 | 10.3 | 5.1 | 2.0 | This invention |
| 7 | B | 43 | 16 | 4.05 | 1.75 | 1.6 | 2.5 | 0.6 | Comparative example |
| 8 | B | 55 | 16 | 3.92 | 1.81 | 10.1 | 4.3 | 2.4 | This invention |
| 9 | B | 49 | 8 | 4.01 | 1.74 | 2.4 | 1.7 | 1.4 | Comparative example |
| 10 | C | 50 | 35 | 2.05 | 1.65 | 5.3 | 2.1 | 2.5 | Comparative example |
| 11 | C | 60 | 15 | 2.03 | 1.63 | 4.2 | 2.1 | 2.0 | Comparative example |

From Table 12, steel Nos. 3, 5, 7, 9, which do not meet the condition of a 30% or more reduction ratio in the final pass or a 10% or more reduction ratio in the final pass and a 50% or more total reduction ratio in the final 3 passes in hot finish rolling, have poor magnetic properties compared with the other examples in the same steel kind. Steel Nos. 10 and 11 have a low magnetic flux density since the Si amount is more than the preferable range of the present invention although the reduction ratio thereof is in the preferable range of the present invention.

On the other hand, steel Nos. 1, 2, 4, 6 and 8, which meet at least one of the conditions of a 30% or more reduction ratio in the final pass or a 10% or more reduction ratio in the final pass and a 50% or more total reduction ratio in the final 3 passes in hot finish rolling, have excellent magnetic properties compared with the other examples in the same steel kind.

What is claimed is:

1. A method of producing an electromagnetic steel sheet having excellent magnetic properties, said steel sheet having a specific resistivity of about 15 $\mu\Omega$·cm or more, a ratio of {100}<001> integration degree to {111}<uvw> integration degree of about 2.0 or more, and crystal grains of about 10 $\mu$m to 500 $\mu$m in diameter which comprises, a) preparing a steel slab having a composition which is adjusted such that the specific resistivity of a resulting product sheet is about 15 $\mu\Omega$·cm or more, and b) subjecting said slab to hot rolling, wherein a large reduction ratio is applied to said steel slab in a final rolling stage, and wherein the finishing temperature is adjusted to about 750 to 1150° C.

2. The method according to claim 1, wherein said reduction ratio is about 30% or more.

3. The method according to claim 2, wherein said final rolling stage is conducted in 1 pass.

4. The method according to claim 1, wherein the total reduction ratio of the final 3 passes in said hot rolling step is about 50% or more, and wherein the reduction ratio in the final pass is about 10% or more.

5. The method according to any one of claims 2, 3 and 4, wherein said slab contains about 0.1 to 3.5% by weight of Si and the {100}<001> integration degree of said product sheet is about 10 or more.

6. The method according to any one of claims 2, 3 and 4, wherein said slab contains about 0.2 to 1.2% by weight of P, and wherein the {100}<001> integration degree of said product sheet is about 3 or more.

7. The method according to claim 5, wherein said slab is made from a component providing a ferrite-austenite transformation temperature of about 750 to 1150° C., and wherein the finishing hot rolling temperature is about $Ar_1$−100 to $Ar_1$+50° C.

8. The method according to claim 5, wherein said slab is made from a component which provides the slab with a ferrite single phase at about 750 to 1150° C., and wherein the finishing hot rolling temperature (°C) is higher than or equal to about 1010°+110×[Si]−5×reduction ratio of the final hot rolling pass (%).

9. The method according to claim 6, wherein said slab is made from a component which provides the slab with a ferrite-austenite transformation at about 750 to 1150° C., and wherein the finishing hot rolling temperature is about $Ar_1$−100 to $Ar_1$+50° C.

* * * * *

UNITED STATES PATENT AND TRADEMARK OFFICE

CERTIFICATE OF CORRECTION

PATENT NO. : 6,416,592 B2
DATED : July 9, 2002
INVENTOR(S) : Kondo et al.

It is certified that error appears in the above-identified patent and that said Letters Patent is hereby corrected as shown below:

Column 2,
Line 60, please change “to have” to -- having --; and
Line 61, please change “and the” to -- , wherein the --.

Column 5,
Line 63, please insert -- , -- after “degree”.

Column 6,
Line 41, please change “to have the” to -- to have a --.

Column 9,
Line 1, please insert -- for that -- after “reason”.

Column 10,
Line 6, please change “of” to -- at --;
Line 7, please change “at” to -- of --;
Line 16, please insert -- above-mentioned -- after “The”.

Column 24,
Line 2, please change “providing” to -- which provides the slab with --.

Signed and Sealed this

Twelfth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,416,592 B2
DATED : July 9, 2002
INVENTOR(S) : Kondo et al.

It is certified that error appears in the above-identified patent and that said Letters Patent is hereby corrected as shown below:

Column 24,
Line 46, please change “110 x [Si]” to -- 100 x [Si] --.

Signed and Sealed this

Eighteenth Day of November, 2003

JAMES E. ROGAN
*Director of the United States Patent and Trademark Office*